US005346725A

United States Patent [19]

Targosz

[11] Patent Number: 5,346,725

[45] Date of Patent: Sep. 13, 1994

[54] TREATMENT FOR NYLON AND OTHER TEXTILES

[76] Inventor: Eugene F. Targosz, 1717 E. Union Hills Dr., Phoenix, Ariz. 85024

[21] Appl. No.: 108,329

[22] Filed: Aug. 18, 1993

[51] Int. Cl.[5] ..... B05D 3/02

[52] U.S. Cl. ..... 427/389.9; 106/18.32; 137/3; 427/392; 427/393.1; 427/393.2; 427/393.4; 428/264; 428/267; 428/270

[58] Field of Search ..... 106/18.32; 427/389.9, 427/392, 393.1, 393.4, 393.2; 428/264, 267, 270; 137/3

[56] References Cited

U.S. PATENT DOCUMENTS

| | | | |
|---|---|---|---|
| 3,361,794 | 1/1968 | Wakeman et al. | 106/18.32 X |
| 3,649,346 | 3/1972 | Bridgeford et al. | 427/393.4 X |
| 4,104,175 | 8/1978 | Martinsson et al. | 427/393.1 X |
| 5,087,487 | 2/1992 | Katz et al. | 427/392 X |

*Primary Examiner*—Michael Lusignan
*Attorney, Agent, or Firm*—Thomas W. Tolpin

[57] ABSTRACT

Running and tearing of nylon hosiery and other hydrophobic fabrics are prevented by immersing the hosiery and fabrics in a special aqueous treatment comprising a film-forming polymeric solution, a wetting agent, a substantive quaternary compound and fabric softener to encourage attachment to the substrate, and an elasticity enhancing plasticizer.

14 Claims, No Drawings

TREATMENT FOR NYLON AND OTHER TEXTILES

BACKGROUND OF THE INVENTION

This invention pertains to textiles and, more particularly, to a process for treating nylon stockings to improve its resistance to running and tearing and enhance other qualities.

Fabrics produced by machines include fabrics knitted from continuous filaments such as ladies' hosiery and the like. Filament fabrics are made of elongated knittable or continuous structure, as distinguished from spun yarn. The continuous filaments are characterized by having a uniform cross section and a smooth surface. One of the difficulties with filamentary knitted materials of fine gauge is that the stitches are susceptible to laddering. For example, in ladies' hosiery, a loop stitch broken at the knee may cause a ladder along the length of the stocking. When hosiery are worn, they are susceptible to lateral tension which tends to weaken and break loop stitches and causes successive stitches to unwind and disengage.

Significantly, nylon stockings and other thin fiber fabrics are very susceptible to running, punctures, snags, wear and damage when they come into contact with finger nails and other abrasive materials such corners of drawers and dressers and other sharp objects. Nylon and other synthetic fibers can also be weakened and damaged by prolonged exposure to heat, sunlight (ultraviolet radiation), rain or body perspiration. When a fiber is severed or damaged, the integrity of the entire fabric is adversely affected and the resulting damage spreads to surrounding areas which generally causes the garment to lose its appeal and effectiveness.

In the past, hosiery was treated to resist runs by spraying the hosiery with adhesive material. However, the adhesive material would form visible patterns and be seen as a blemish on the hosiery, as well as reduces the hosiery's elasticity to a fraction of what it was prior to the spray treatment.

Over the years various techniques have been suggested for improving hosiery, fibers and other textiles, such as those disclosed in U.S. Pat. Nos. 3,784,497; 4,917,920; 4,970,110 and 5,066,521. These prior art techniques have met with varying degrees of success.

Accordingly, an improved treatment which increases the resistance of fabrics and reduces the possibility of fiber rupture without adverse effects is extremely useful and desirable. It is, therefore, desirable to provide an improved treatment for nylon and other textiles which overcomes most, if not all, of the preceding problems.

SUMMARY OF THE INVENTION

An improved process is provided to enhance the performance and wearing qualities of textile fibers and clothing. Advantageously, the novel process is easy to use, economical, safe, effective, and dependable. The novel process is particularly useful with nylon fibers, such as to prevent running and tearing of nylon stockings and pantyhose. The novel process can also be advantageously used to treat and enhance the performance and wearing qualities of other textile fibers such as made of rayon, dacron, cotton, linen, hemp, polyester, polyethylene, polypropylene, polyamides, wool, or silk.

The textile fibers can be natural fibers, regenerated fibers, synthetic fibers, and yarns produced by spinning, plying, weaving or other fabrication techniques. Polyamide fibers can be made of nylon, polymetaxylene adipamide, polyparaxylylene decanamide, poly-bis-cyclohexylmethane decanamide, copolyamides thereof and the like. Polyester fibers can be made of polyethylene terephthalate, polytetramethylene terephthalate, polyethylene oxybenzoate, poly-1,4-dimethyl cyclohexane terephthalate, polypivalolactone, copolyesters thereof and the like.

To this end, the novel process includes treating the textile fibers with a composition produced by aquatically mixing (i.e. mixing in water) a quaternary substantive compound having an affinity to enhance the softness and abrasion resistance of the textile fibers with a partially hydrolyzed film-forming polymer having an affinity to attach to the textile fibers. The quaternary compound known to have anti-fungal properties, preferably comprises dimethyl ammonium chloride and fatty acids and has an affinity to prevent fungus and yeast infections such as in women's panties, hosiery, and underwear, as well as provides anti-static qualities to the textile fibers. For enhanced results, prior to the mixing of the quaternary compound and the polymer, a surface tension reducing additive, such as a wetting agent, emulsifier, or surfactant, and a defoamer, are added and mixed into the water.

To increase the strength of the textile fibers, a plasticizer can be mixed with the quaternary compound. Desirably, a biocide is also mixed with the quaternary compound and polymer to prevent degradation, smelling and miscoloring of the product (composition). The product can also be enhanced with a fragrance, fragrance enhancer, and/or colorant(s).

In the preferred process, clothing comprising nylon stockings, pantyhose, fabrics, synthetic fibers, or other hydrophobic textiles, are treated with an effective amount of a composition comprising by weight: 60–90% water; 0.01–2% surface tension decreasing additive; 0.1–1% silicon-containing defoamer; 0.5–10% partially hydrolyzed film-forming polymer, such as polyvinyl alcohol, polyvinyl acetate, or polyacrylic acid and acrylic copolymers; 0.5–15% plasticizer, such as propylene glycol, 2 pyrolodone, tributoxylethyl phosphate, dibutyl phthalate, or diethyl phthalate; and 0.2–25% quaternary compound having substantive characteristics and an affinity to adhere to textile fibers.

For best results, the composition comprises by weight: 80–85% water; 6–8% polyvinyl alcohol, 0.2–25% quaternary substantive compound, 5–7% propylene glycol, 0.01–0.03% formaldehyde, 0.5–10% isopropyl alcohol, 0.001–0.25% of at least one colorant, such as a red colorant and/or orange colorant.

In accordance with this invention, nylon stockings, fine or sheer knit goods and other textiles are treated with a solution comprising a polymeric resin and a quaternary compound in effective amounts sufficient to resist runs, snags, and tears e.g., amounts ranging up to about 3% by weight of the fabric. The solution also enhances the textile's performance, flexibility, wearing qualities and durability. The treatment of fine gauge knitted materials in accordance with this invention involves forming a film on the hosiery to prevent laddering and also to maintain a sufficient degree of elasticity to ensure a good comfortable fit. Desirably, the composition (product) can be applied to fabrics by consumers in a home environment in a simple, safe, non-hazardous way.

A more detailed explanation of the invention is provided in the following description and claims.

DETAILED DESCRIPTION OF THE PREFERRED EMBODIMENTS

A composition is provided to treat and enhance the performance of clothing, which when applied to the clothing increases the its strength longevity and wear. The composition is particularly useful to minimize running, ripping and tearing of hydrophobic textiles, such as nylon stockings, including pantyhose and other nylon hosiery. Nylon stocking are conveniently, easily and effectively treated by immersing, dipping, washing or otherwise contacting the nylon stockings in the composition (product) from 5 seconds to 5 minutes, preferably from 15 seconds to 45 seconds, and most preferably for approximately 30 seconds. The concentrated composition can be diluted in water at a ratio ranging from about 1:2 to about 1:40.

The composition (product) is produced by dispensing, placing or pouring liquid comprising substantially water, into a vessel, such as a tank, tub trough, bowl, or other container to place and at least partially fill the vessel with water. The temperature of the water in the vessel should be regulated so as to remain in the range from 35 degrees F. (2 degrees C.) to 150 degrees F. (66 degrees C.) and is preferably at atmospheric pressure. To minimize heating requirements, the temperature of the water can be kept at room (ambient) temperature. The surface tension of the water is then lowered with a surface tension-decreasing additive comprising a wetting agent, emulsifier or surfactant, to enhance the dispersion and solubility of the polymer as well as to enhance the adhesion of the composition on nylon stockings or other textile fabrics or clothing. Thereafter, the water is defoamed, preferably with a silicon-containing defoamer, and mixed with a partially hydrolyzed polymer having an affinity to form a film, plate onto and attach to the nylon stockings or other textile fabrics or clothing. A plasticizer is added and mixed with the polymer to enhance the strength, elasticity and film forming qualities of the polymer and to form a colloidal polymeric suspension. A quaternary ammonium compound is mixed and added to the colloidal polymeric suspension of the polymer and plasticizer to increase the substantive and fabric softening qualities in addition to increasing the abrasion resistance, bursting strength and softness of the nylon stockings or other textile fabrics or clothing. The polymeric colloidal suspension is colored with at least one and preferably two biodegradable non-irritating colorants which are generally safe and non-allergenic to human skin. A fragrance enhancer and fragrance can be added and mixed with the suspension to enhance the odor and fragrance of the product. The polymeric suspension is also treated with an anti-foulant, such as a biocide, to prevent the composition from biodegrading, decaying and smelling as well as to prevent blotching, streaking and other miscoloring of the product. The polymeric suspension is then removed from the vessel.

The quaternary compound in combination with the polymer and other components listed above, provide a synergistic composition (product) that is useful to resist tearing, running and scratching of nylon stocking or other textile fabrics or clothing. The synergistic product also provides the treated nylon stockings or other textile fabrics or clothing with better: elasticity, softness, lubricity, non-clinging anti-static qualities, feel, bursting and tensile strength by as much as 10%, and tear and abrasion resistance, especially to fingernails.

In the preferred process, the surface tension of the water is lowered by mixing from 0.01–1% by weight of a fluorocompound wetting agent in the water from 30 seconds to 5 minutes. Unless otherwise specified in this application, the given % (percentage) is based upon the total finished weight of the composition (product). The water is defoamed and mixed with 0.1–1% by weight with a silicon based defoamer for 3–5 minutes. The polymer comprises polyvinyl alcohol, polyvinyl acetate, polyacrylic acid, acrylic copolymers, or combinations thereof, and is mixed with the defoamed water from 1 to 12 hours. From 0.5–15% by weight plasticizer, comprising propylene glycol, 2 pyrolodone, tributoxylethyl phosphate, dibutyl pthalate, diethyl pthalate, or combinations thereof, is mixed with the polymer in the water from 1–5 minutes. From 0.2–25% quaternary compound is mixed with the colloidal polymeric suspension from 1–20 minutes. Biodegradation is prevented by mixing 0.01–0.03% by weight of an anti-foulant comprising formaldehyde or another biocide, with the polymeric suspension from 1–10 minutes. The fragrance of the product is enhanced by mixing 0.5–10% by weight isopropyl alcohol with an appropriate fragrance to the polymer and mixed for 3–20 minutes.

For best results, the surface tension is lowered by mixing from 0.04–0.06%, preferably 0.05% by weight of a fluorocompound wetting agent comprising ammonium perfluoroalkyl sulfonates in the water for 45–75 seconds, preferably 60 seconds. The liquid comprising water is defoamed and mixed with less than 0.2% by weight a silicon based defoamer comprising polydimethyl siloxane. The polymer comprises polyvinyl alcohol and is mixed with the water from 4–8 hours. From 5–10% by weight quaternary compounds comprising dicocodimonium chloride are mixed with the polymer from 3–5 minutes. Plasticizer comprising 5–7% by weight propylene glycol is mixed with the polymer in the water for 2 minutes. Biodegradation is prevented by mixing the polymeric suspension from 4–6 minutes, preferably 5 minutes with an anti-foulant comprising formaldehyde or a biocide comprising magnesium nitrate, magnesium chloride, 5-chloro-2-methyl-4-isothiazolin-3-one, and 2-methyl-4-isothiazolin-3-one. The polymeric suspension is colored with 0.001–0.25% by weight orange colorant and 0.001–0.25% by weight red colorant.

As indicated above, the preferred quaternary ammonium compound is dicocodimonium chloride, which is also known as dicoco alkyldimethyl, chlorides or dicoco dimethyl ammonium chloride or Di-C8-18-alkyldimethyl, chlorides. This can be used in combination with isopropanol, such as 20–30% isopropanol. The quaternary compound attaches to and forms a protective film on the textile fibers to be treated. The preferred source of quaternary compound comprises: 70–80% quaternary ammonium compound and less than 0.03% methyl chloride, has a specific gravity of about 0.87 at 115 degrees F., a vapor pressure of 33 mm/Hg at 68 degrees F., an initial boiling point of 180 degrees F. at 760 mm/Hg, and a volatility of 20–30%, and is produced under the brand name CarSpray 300 by Witco Corporation, Dublin, Ohio, USA. The quaternary compound can provide disinfecting qualities and serves as a fungicide to disinfect and sanitize the clothing or fabric being treated as well as to resist fungus and yeast infections.

While the above quaternary ammonium compound is preferred for best results, in some circumstances it may be desirable to use other quaternary ammonium compounds, such as produced under the brand name Jet Quat 2C-75 by Jetco Chemicals, Inc. of Corsicana, Tex., USA, or produced under the bramd names Carspray 400 and Carnauba Spray 200 by Witco Corporation, Dublin, Ohio, USA, or containing 9% denatured ethyl alcohol such as sold under the brand name BTC 2125M by Stephan Company, Northfield, Ill., USA, or the following MAQUAT products comprising n-alkyl dimethyl benzyl ammonium chloride produced by Mason Chemical Company, Arlington Heights, Ill., USA. LC-12S (67% C12, 25% C14, 7% C16, 1% C18), MC 1416 (5% C12, 60% C14, 30% C16, 5% C18), MC1412 (40% C12, 50% C14, 10% C16), SC-18 stearyl paste or flake (5% C16, 95% C18), TC-76 or MQ-2525 (5% C12, 60% C14, 30% C16 , and 5% C18) and MC6025-50% (25% C12, 60% C14 and 15% C16). Jet Quat 2C-75 comprises: 50–75% dicoco dimethyl quatenary ammonium chloride, 20–50% isopropyl alcohol, has a specific gravity of 0.88 and a boiling point of 180 degrees F. Car-Spray 400 comprises: 55–65% quaternary ammonium compounds, 20–30% amines, C14–18 & C16–18 unsaturated, alkyl, ethoxylated, 10–20% isopropanol, and less than 0.03% methyl chloride, and has a specific gravity of approximate 0.88 at 75 degrees, F., a vapor pressure of 33 mm/Hg at 68 degrees F., an initial boiling point of 180 degrees F. at 760 mm/Hg, and a volatility of 10–20%. Carnauba Spray 200 comprises: 50–60% quaternary ammonium compounds, 10–20% isopropanol, 15–25% water, 1–10% alkoylated carnauba wax, and less than 0.03% methyl chloride, and has a specific gravity of about 0.90 at 80 degrees F., a vapor pressure of 33 mm/Hg at 68 degrees F., an initial boiling point of 180 degrees F. at 760 mm/Hg, and a volatility of 20–40%.

Polyvinyl alcohol combines high tensile strength with ease of film formation. Polyvinyl alcohol also have excellent adhesive and bonding characteristics. Polyvinyl alcohols can be used for textile warp sizing and exhibit high abrasion resistance, elongation and flexibility. Polyvinyl alcohol resins are generally unaffected by greases, petroleum hydrocarbons, animal oils and vegetable oils. Resistance to organic solvents increases with the degree of hydrolysis. The degree of hydrolysis affects water sensitivity of both resin and film polyvinyl alcohol. Water resistance increases with increasing hydrolysis. Partially hydrolyzed polyvinyl alcohol have generally better adhesion to hydrophobic surfaces and provide superior tear resistance and weavability. Polyvinyl alcohol also serves as a dispersing agent and stabilizing agent. Polyvinyl alcohol also function as a protective colloid and can enhance emulsifying action at very low concentrations.

The physical properties of polyvinyl alcohol include: a white to cream colored granular powdered appearance; a bulk density of 40 lbs./cu. ft.; a specific gravity of 1.27–1.31; thermal stability which results in gradual discoloration at about 100 degrees C., darkens rapidly above 150 degrees C., and rapidly decomposes above 200 degrees C.; has a refractive index of 1.55 at 20 degrees C.; a thermal conductivity of 0.2 W/9 m.K, a specific heat of 1.5 J/(g.K), and excellent stability in sunlight. Polyvinyl alcohol should first be dispersed in cold or room temperature water using sufficient agitation to wet out all particles with water. The solution temperature can be elevated to 185–205 degrees F. (85–96 degrees C.) for about 30 minutes.

The preferred polyvinyl alcohol for best results has a hydrolysis of 87–90%, a viscosity of 45–55 cps, a pH o 4.0–6.0 , a volatility of 5%, and 0.3% maximum ash, such as produced under the brand name of Airvol 540S by Air Products and Chemicals, Inc., Allentown, Pa, USA. In some circumstances it may be desirable to use other polyvinyl alcohols, such as: Airvol 205S and Airvol 523S produced by Air Products and Chemicals, Inc. or polyvinyl alcohol products with a maximum of 3% methanol, such as produced by Hoechst Celanese Corporation, Charlotte, N.C., USA under the brand names of MOWIOL 30-92, 40-88 or 66-100, with a melting point of 160–200 degrees C., a density of 1.25–1.35 g/cm3, a solubility in water of 20–85 g/l and decomposition temperature of 160 degrees C.; or to use polymers of vinyl acetate, crotonic acid and vinyl acetate, or copolymers of vinylpyrrolidone with vinyl acetate; or acrylic polymers. Polymers useful in preparing the hosiery treatment compositions of this invention are film-forming resins which, when applied to the hosiery, improve the run and snag resistance of the knitted fabric.

Isopropyl alcohol, also known as 2-propanol or dimethyl carbinol, has: a molecular weight of 60.1, a boiling point of 82.26 degrees C. at 760 mm/Hg, a specific gravity of 0.7864 at 20 degrees C., a vapor density of 2.07, a freezing point of −88.5 degrees C., a vapor pressure of 33 mm/Hg, is completely soluble in water at 20 degrees C., is 100% volatile, and has an evaporation rate of 2.88. Isopropyl alcohol increase the solubility of the polymer and enhances the fragrance of the product (composition) to be applied to the textiles fibers.

Formaldehyde, also known as methylene oxide, formalin and methylene glycol, has: a boiling point of 204–213 degrees F., a vapor pressure of 37 mm/Hg at 47 degrees C. a vapor density of 1.03, a specific gravity of 1.1–1.2, and a water solubility of 100%. A preferred biocide for best results comprise; 1.05–1.25% 5-chloro-2-methyl-4-isothiazolin-3-one, 0.25–0.45% 2-methyl-4-isothiazolin-3one; 0.5–1% magnesium chloride; 21–25% magnesium nitrate; and 74–77% water; such as produced under the brand name of Kathon (R) CG preservative by Rohm and Haas Company, Philadelphia, Pa. USA.

Another useful biocide comprises; 67.5% 1(3 -chloroallyl)-3,5,7-tiraza-1-azoniadamantane chloride, 25% sodium bicarbonate, 4% hexamethylenetetramine hydrochloride, has a molecular weight of 251.2, with a solubility in water of 20 g/100 g, such as produced by Dow Chemical USA, Midland, Mich., USA under the brand name DOWICIL 75 Preservative. A further useful biocide comprises 99% hydantoin, also known as glycolyurea or 2,4-imidazolidinedione, with a melting point of 221–223 degrees C., such as available from Aldrich Chemical Company, Milwaukee, Wis., USA under Product #15636-1.

The preferred surfactant for best results is an anionic fluorochemical surfactant or a fluorocompound wetting agent, comprising: 37.5% 2-butoxy-ethanol, 37.5% water, and less than 30% ammonium perfluoroalkyl sulfonate, with a boiling point of approximately 96 degrees C. a vapor pressure of 27.2 mm/Hg, a vapor density of about 0.7, a pH of 8.5–9.5, and is 75% volatile, such as sold under the FLUORAD brand name of FC-120 by 3M Company, St. Paul, Minn., USA. The wetting agent provides better adhesion of the product (composition) on the textile fabric to be treated and helps form a protective layer.

In some situations, it may be desirable to use other fluorosurfactants or fluorocompound wetting agents, such as sold by 3M Company under the FLUORAD brand names FC-109, FC 121, FC-129 and FC-170C, or fluorosurfactants sold by E.I. Du Pont de Nemours & Company of Wilmington, Del., USA under the ZONYL brand names FSP, FSE, FSE, FSJ, FSN, FSN-100, FSO, FSO-100, FSC, and TBS. Fluorsurfactants can be used alone or with a hydrocarbon surfactant.

The surfactant FC-109 is an anionic fluorochemical surfactant comprising: 61% water, 12% dipropylene glycol monomethyl ether, 2% ethanol, and 25% potassium fluoralkyl carboxylates, with a boiling point of approximately 173 degrees F., a vapor pressure of about 30 mm/Hg, a vapor density of less than 0.6% , a specific gravity of approximately 1.1, a pH of 8–11, and a volatility of about 75%. FC-121 is an anionic fluorochemical surfactant comprising: 40% water, 35% propylene glycol monotertiary butyl ether, and 25% ammonium perfluoroalkyl sulfonates, with a boiling point of about 212 degrees F., a vapor pressure of 28 mm/Hg, a vapor density of 0.7, a specific gravity of approximately 1.1, a pH of 8.5–9.5, and a volatility of approximately 75%. FC-129 is an anionic fluorochemical surfactant comprising: 32% water, 14% 2-butoxy-ethanol, 4% ethanol, and less than 40% potassium fluoralkyl carboxylate, with a boiling point of approximately 212 degrees F., a vapor pressure of about 28 mm/Hg, a vapor density of about 0.7, a specific gravity of approximately 1.3, a pH of about 8–11, and is approximately 50% volatile. FC-170C is a fluorochemical surfactant comprising: approximately 70% fluoroaliphatic oxyethylene adduct, 12% polyoxyetheylene glycol, a maximum of 7% water, with a boiling point of about 210 degrees C., a vapor pressure of 31 mm/Hg, a vapor density of 0.61, a specific gravity of 1.3, a pH of 6–8, and a volatility of about 7%.

ZONYL FSK is a fluorinated surfactant comprising: 53% acetic acid, 47% polytetrafluoroethylene (PTFE) alpha-(2-acetoxy-3-(carboboxymethyl) dimethylammonio(propyl)-omega-fluoro-inner salt, has a boiling point of 118 degrees C. at 760 mm/Hg, a vapor density of 2.1, a specific gravity of 1.2 and is 53% volatile. ZONYL FSO is a fluorinated surfactant comprising: 50% telomer B monoether with polyethylene glycol, 25% ethylene glycol, 25% water, has a boiling point of 100 degrees C., a vapor density of 2.1, a specific gravity of 1.3 and is 50% volatile. ZONYL FSP is a fluorinated surfactant comprising: 20% isopropyl alcohol, 40–45% water and the balance telomer B phosphate ammonium salt, has a specific gravity of 1.15, a pH of 6–8, and is 65% volatile. ZONYL FSN is a fluorinated surfactant comprising: 40% telomer B monoether with polyethylene glycol, 30% isopropyl alcohol, 30% water, a boiling point of -80 degrees C. at 760 mm/Hg, a specific gravity of 1.06 a pH of 7.5–8.5 and is 60% volatile.

A useful fragrance is produced by Belle-Aire Fragrances, Inc., Mundelein, Ill. USA under the brand name of Fragrance Compound (S).

The preferred colorants are: basic violet 10, also known as rodamine B, and acid orange 7, also known as acid orange YA, both available from Keystone Analine & Chemical Company, Sante Fe, Calif., USA. In some circumstances, it may be desirable to use one or more other colorants, such as FDC (Federal Food & Drug Commission) Nos. 1 (blue), 3 (red), 5 (yellow), 6 (yellow), and 340 (red), or the following colorants available from Keystone Analine & Chemical Company: acid blue 40 (90 g/l solubility in water), keyacid blue 2GL (90 g/l solubility in water), and food blue #2 (20% solubility in water).

The plasticizer increases the tensile and bursting strength of the polymer and increases the film forming characteristics and elasticity of the product (composition). The preferred plasticizer is propylene glycol to increase flexibility and workability and for best results. Condensed with equimolar quantities of polybasic acid, it forms plasticizers of the polymeric type. Condensation of two moles of a monocarboxylic acid and one mole of propylene glycol produces a plasticizer of the monomeric type. Propylene glycol (1,2-propanediol) is completely miscible with water and is about three times as viscous as ethylene glycol at room temperature. It also serves as a softening agent, spreader, emollient, humectant and preservative and tends to inhibit swelling of silicon-based compounds. In some circumstances, it may be desirable to use other plasticizers, such as: ethylene glycol, diethylene glycol, dipropylene glycol, hexylene glycol, tetraethylene glycol, dibutyl phthalate, or tributoxyethyl phosphate. Ethylene glycol, also known as ethane-1,2-diol or ethanediol, has a molecular weight of 62.07, a specific gravity of 1.1, a boiling point of 387 degrees F., a vapor pressure of 0.08 mm/Hg, a vapor density of 2.1 and is 100% soluble in water. Diethylene glycol has a boiling point of 246 degrees F., a specific gravity of 1.118, a vapor density of 3.66, and is 100% soluble in water. Dibutyl phthalate has a boiling point of 635 degrees F., a specific gravity of 1.05, a vapor density of 9.6 and is less than 0.01% soluble in water. Tributoxyethyl phosphate has a specific gravity of 1.018, a boiling range of 215–228 degrees C. at 4 mm/Hg, a viscosity of 12.2 cp at 20 degrees C. and is 0.11% soluble in water at 25 degrees C.

The preferred defoamer for suppressing foam in the aqueous suspension is a silicon-based defoamer comprising polydimethylsiloxane that contains 10% active silicone, such as produced under the brand name SAG 10 antifoam by Union Carbide of Danbury, Connecticut, USA. This defoamer is particularly suited for long term durability. It is also stable and easy to handle. In some circumstances, it may be desirable to use other defoamers such as the following antifoam emulsions and compounds produced by Union Carbide: SAG 30 (30% active silicone), SAG 5693 (polyalkylene glycol/silicon), SAG 4130, SAG 4220, SAG 5441, SAG 710 and SAG 730.

It is found that the physical and chemical characteristics of composition (product) are particularly suited for this application. The product is compatible with a wide range of textiles. When applied to a fiber, its solutions produce a transparent film that adheres to the fibers and coats it with a resilient protective layer. The film is strong, durable and smooth, which all contribute to its usefulness as a protective coating for nylon and other textile fibers. The addition of coloring and fragrance may be useful to enhance consumer acceptance and attractiveness of the product.

The product can be prepared in an enclosed inert vessel equipped with a variable speed motor. The required amount of water is first introduced into the vessel at room temperature and pressure. With the mixer producing a moderate rate of agitation, the corresponding amount of polymer is added and mixed until a completely uniform solution is obtained. The step is then repeated while adding the quaternary compound and other ingredients (compounds) discussed above. Finally, the coloring and fragrance are added and mixed. The resulting solution is ready enclosed in bottles or other suitable containers.

Tests were conducted by which the product (composition) was formulated, blended and produced and applied to nylon stockings as specified in the preferred process described above. The resultant nylon stockings had a pleasing appearance with a uniform homogeneous film comprising the composition. It was unexpectedly and suprisingly found that the resultant nylon stockings had an increased bursting tear strength of 7–8% and had the other qualities and advantages described below.

Among the many advantages of the novel precess for treating nylons and other textiles are: (1) superior resistance to tearing, running, snagging, and abrasion; (2) greater customer appeal; (3) outstanding wear performance; (4) better softness and feel; (5) excellent elasticity and strength; (6) anti-static non-clinging; (7) safe; (8) cost effective; (9) simple to use; (10) superb quality; (11) convenient; (12) reliable; (13) efficient; and (14) effective.

Although embodiments of the invention have been shown and described, it is to be understood that various modifications and substitutions, as well as rearrangements of parts, components, compounds, and process steps, can be made by those skilled in the art without departing from the novel spirit and scope of this invention.

What is claimed is:

1. A process for enhancing the performance and wearing qualities of textile fibers by treating the textile fibers with a composition produced by the steps, comprising:

aquatically mixing a quaternary compound having an affinity to enhance the softness and abrasion resistance of textile fibers selected from the group consisting of nylon, rayon, dacron, cotton, linen, hemp, polyester, polyethylene, polypropylene, polyamides, wool, and silk, with a partially hydrolyzed film-forming polymer having an affinity to attach to said textile fibers, said polymer being selected from the group consisting of polyvinyl alcohol and polyvinyl acetate, after mixing a plasticizer with said polymer to increase the strength of the textile fibers, said plasticizer being selected from the group consisting of propylene glycol, ethylene glycol, diethylene glycol, dipropylene glycol, hexylene glycol, tetraethylene glycol, 2 pyrolodone, tributoxylethyl phosphate, dibutyl phthalate, and diethyl phthalate.

2. A process in accordance with claim 1 including mixing a surface tension decreasing additive selected from the group consisting of a wetting agent, emulsifier, and surfactant with a liquid comprising water before said aquatic mixing of said quaternary compound and said polymer.

3. A process in accordance with claim 2 further adding a defoamer to the liquid prior to said aquatic mixing.

4. A process in accordance with claim 1 including mixing a biocide with said quaternary compound and polymer to prevent degradation, smelling and miscoloring of the composition.

5. A process in accordance with claim 1 including enhancing the composition with at least one member selected from the group consisting of a fragrance, fragrance enhancer, and a colorant.

6. A process in accordance with claim 1 including substantially sanitizing said textile fibers with a quaternary compound comprising dimethyl ammonium chloride having an affinity to minimize fungus and yeast infections.

7. A process for enhancing the performance of clothing selected from the group consisting of nylon stockings, pantyhose, fabrics, synthetic fibers, and hydrophobic textiles, by treating said clothing with an effective film forming amount of a composition comprising by weight:

from about 60% to about 90% water;

from about 0.01 to about 2% surface tension decreasing additives comprising a member selected from the group consisting of ammonium perfluoroalkyl sulfonates, fluorinated alkyl alkoxylates, ammonium perfluoroalkyl sulfonates, potassium fluoroalkyl carboxylates, and fluoroaliphatic oxyethylene adducts, telomer B, and polytetraethylene;

from about 0.1% to about 1% silicon-containing defoamer;

from about 0.5% to about 10% partially hydrolyzed film-forming polymer selected from the group consisting of polyvinyl alcohol and polyvinyl acetate;

from about 0.5% to about 15% plasticizer selected from the group consisting of propylene glycol, ethylene glycol, diethylene glycol, dipropylene glycol, hexylene glycol, tetraethylene glycol, 2 pyrolodone, tributoxylethyl phosphate, dibutyl phthalate, and diethyl phthalate; and from about 0.2% to about 25% quaternary compound having an affinity to adhere to the clothing.

8. A process in accordance with claim 7 wherein said composition comprises by weight:

from about 80% to about 85% water;

from about 0.04% to about 0.06% surface tension decreasing additives comprising ammonium perfluoroalkyl sulfonates;

less than about 0.2% silicon-containing defoamer comprising polydimethyl siloxane;

from about 6% to about 8% polyvinyl alcohol;

from about 5% to about 7% propylene glycol;

from about 0.01% to about 0.03% of an anti-foulant comprising a member selected from the group consisting of formaldehyde and a biocide comprising magnesium nitrate, magnesium chloride, 5-chloro-2-methyl-4-isothiazolin-3-one, and 2-methyl-4-isothiazolin-3-one;

from about 0.5% to about 10% isopropyl alcohol;

from about 5% to about 10% of a quaternary compound comprising dimethyl ammonium chloride;

from about 0.001% to about 0.25% of at least one colorant selected from the group consisting of a red colorant and an orange colorant.

9. A process for producing a composition for treating and enhancing the performance of clothing, comprising the steps of:

dispensing a liquid comprising water into a vessel selected from the group consisting of a tank, tub trough, bowl, and container;

regulating the temperature of the liquid in the vessel in the range from about 35 degrees F. (2 degrees C.) to about 150 degrees F. (66 degrees C.);

lowering the surface tension of the liquid with at least one member selected from the group consisting of a wetting agent, emulsifier and surfactant, to enhance the adhesion of the composition on clothing; defoaming the liquid;

mixing a partially hydrolyzed polymer having an affinity to form a film and attach to said clothing with said defoamed liquid;

enhancing the strength, elasticity and film forming qualities of said polymer with a plasticizer;

forming a colloidal polymeric suspension of said polymer and said plasticizer; increasing the abrasion resistance, bursting strength and softness of the clothing by mixing and attaching a quaternary ammonium compound to the clothing with the colloidal polymeric suspension of said polymer and plasticizer;

coloring said polymeric colloidal suspension with at least one biodegradable colorants;

preventing biodegrading, smelling and streaking of said polymeric colloidal suspension; and separating said polymeric colloidal suspension with said quaternary compound from a substantial portion of said liquid to form a composition useful to resist tearing of clothing.

10. A process in accordance with claim 9 including increasing the bursting strength of clothing selected from the group consisting of nylon hosiery, pantyhose, synthetic fibers, hydrophobic textiles, and nylon fabrics, by contacting said composition with said clothing from about 5 seconds to about 5 minutes.

11. A process in accordance with claim 9 including substantially minimizing running and tearing of nylon stockings by immersing said nylon stockings in said composition from about 15 seconds to about 45 seconds.

12. A process is accordance with claim 9 wherein:

said surface tension is lowered by mixing from about 0.01% to about 2% by weight of a fluorocompound wetting agent in the water from about 30 seconds to about 5 minutes, said fluorocompound wetting agent comprising a member selected from the group consisting of ammonium perfluoroalkyl sulfonates, fluorinated alkyl alkoxylates, ammonium perfluoroalkyl sulfonates, potassium fluoroalkyl carboxylates, and fluoroaliphatic oxyethylene adducts, telomer B, and polytetraethylene;

said liquid comprising said water is defoamed and mixed with about 0.1% to about 1% by weight with a silicon based defoamer for about 3 minutes to about 5 minutes;

from about 0.5% to about 10% by weight of said polymer is mixed with said defoamed water from about 1 hour to about 12 hours, said polymer comprising a member selected from the group consisting of polyvinyl alcohol, polyvinyl acetate, polyacrylic acid;

from about 0.5% to about 15% by weight of said plasticizer is mixed with said polymer in the water from about 1 minute to about 5 minutes, said plasticizer comprising a member selected from the group consisting of propylene glycol, ethylene glycol, diethylene glycol, dipropylene glycol, hexylene glycol, tetraethylene glycol, 2 pyroloidone, tributoxyethyl phosphate, dibutyl phthalate, and diethyl phthalate;

from 0.2% to about 25% by weight of said quaternary ammonium compound is mixed with the colloidal polymeric suspension from about 1 minute to about 20 minutes, said quaternary ammonium compound comprising dimethyl ammonium chloride;

said biodegradation is prevented by mixing from about 0.01% to about 0.03% by weight of an anti-foulant comprising a member selected from the group consisting of formaldehyde, hydantoin, 1-(3-chloroallyl)-3,4,7-tiraza-1azoniaadamantane chloride, and a biocide, with the polymeric suspension from about 1 minute to about 10 minutes; and mixing from about 0.5% to about 10% by weight isopropyl alcohol with the polymer for about 3 minutes to about 20 minutes.

13. A process in accordance with claim 12 wherein:

said surface tension is lowered by mixing from about 0.04% to about 0.06% by weight of a fluorocompound wetting agent comprising ammonium perfluoroalkyl sulfonates in the water for about 45 seconds to about 75 seconds;

said liquid comprising said water is defoamed and mixed with less than about 0.2% by weight a silicon based defoamer comprising polydimethyl siloxane;

said polymer comprises polyvinyl alcohol and is mixed with the liquid from about 4 hours to about 8 hours;

from about 5% to about 10% by weight quaternary compounds comprising dicocodimonium chloride are mixed with the polymer from 3 minutes to about 5 minutes;

said plasticizer comprises 5% to about 7% by weight propylene glycol;

said biodegradation is prevented by mixing from an anti-foulant with said polymeric suspension from about 4 minutes to about 6 minutes, said anti-foulant comprising a member selected from the group consisting of formaldehyde and a biocide comprising magnesium nitrate, magnesium chloride, 5-chloro-2-methyl-4-isothiazolin-3-one, and 2-methyl-4-isothiazolin-3-one; and said polymeric suspension is colored with about 0.001% to about 0.25% by weight orange colorant and from about 0.001% to about 0.25% by weight red colorant.

14. A composition produced by the process of claim 13.

* * * * *